US009048586B2

(12) United States Patent
Yamac

(10) Patent No.: US 9,048,586 B2
(45) Date of Patent: Jun. 2, 2015

(54) EARTH CONNECTION FOR ELECTRICALLY AND MECHANICALLY CONNECTING EARTH WIRES

(71) Applicant: Airbus Operations GmbH, Hamburg (DE)

(72) Inventor: Oezguer Yamac, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 155 days.

(21) Appl. No.: 13/765,937

(22) Filed: Feb. 13, 2013

(65) Prior Publication Data

US 2013/0210248 A1 Aug. 15, 2013

Related U.S. Application Data

(60) Provisional application No. 61/598,429, filed on Feb. 14, 2012.

(30) Foreign Application Priority Data

Feb. 14, 2012 (DE) ..... 10 2012 202 231

(51) Int. Cl.
*H01R 13/652* (2006.01)
*H01R 4/64* (2006.01)

(52) U.S. Cl.
CPC ..... *H01R 13/652* (2013.01); *H01R 4/64* (2013.01)

(58) Field of Classification Search
CPC . H01R 13/652; H01R 24/78; H01R 13/65802
USPC ..... 439/103, 608, 92, 101, 676
See application file for complete search history.

(56) References Cited

U.S. PATENT DOCUMENTS

| | | | | |
|---|---|---|---|---|
| 4,732,568 | A * | 3/1988 | Hall | 439/676 |
| 5,092,790 | A * | 3/1992 | Justiano et al. | 439/351 |
| 5,306,164 | A * | 4/1994 | Hollander et al. | 439/103 |
| 5,645,435 | A * | 7/1997 | Cimino et al. | 439/92 |
| 5,829,991 | A * | 11/1998 | Murphy et al. | 439/98 |
| 6,287,131 | B1 * | 9/2001 | Deng | 439/103 |
| 6,293,811 | B1 * | 9/2001 | Frantz | 439/101 |
| 2002/0009909 | A1 | 1/2002 | Kondoh | |

(Continued)

FOREIGN PATENT DOCUMENTS

| | | |
|---|---|---|
| DE | 3441297 | 5/1986 |
| DE | 3822147 | 1/1990 |

(Continued)

OTHER PUBLICATIONS

German Search Report, Jan. 22, 2013.

*Primary Examiner* — Truc Nguyen
(74) *Attorney, Agent, or Firm* — Greer, Burns & Crain Ltd.

(57) ABSTRACT

An earth connection for electrically and mechanically connecting a plurality of earth wires to a structure, in particular to an aircraft structure, comprising an angled element which element is formed in one piece and is made of electrically conductive material, which comprises a first and a second fastening portion. The first fastening portion is fastened to the structure and the second fastening portion comprises a plurality of electrical connections for connecting the earth wires. The electrical connections comprise socket contact elements which are formed so as to receive pin contact elements of the earth wires.

11 Claims, 1 Drawing Sheet

(56) References Cited

U.S. PATENT DOCUMENTS

| | | | |
|---|---|---|---|
| 2005/0039941 | A1 | 2/2005 | Marroquin et al. |
| 2011/0217857 | A1 | 9/2011 | Truskett et al. |

FOREIGN PATENT DOCUMENTS

| | | |
|---|---|---|
| DE | 19536641 | 1/1997 |
| DE | 10356469 | 7/2004 |

* cited by examiner

EARTH CONNECTION FOR ELECTRICALLY AND MECHANICALLY CONNECTING EARTH WIRES

CROSS-REFERENCES TO RELATED APPLICATIONS

This application claims the benefit of the U.S. Provisional Application No. 61/594,429, filed on Feb. 14, 2012, and of the German patent application No. 102012202231.7 filed on Feb. 14, 2012, the entire disclosures of which are incorporated herein by way of reference.

FIELD OF THE INVENTION

The present invention relates to an earth connection for electrically and mechanically connecting a plurality of earth wires. The invention further relates to an aircraft comprising the earth connection according to the invention

BACKGROUND OF THE INVENTION

It is known to fasten an angled element to a structure by means of riveted or screwed connections. The earth wires to be connected to the structure comprise cable lugs which are fastened to an associated fastening portion of the angled element using screws, washers and threaded nuts. For this purpose, there are through-holes for example inside the fastening portion of the angled element, which through-holes are penetrated by the screws. It is disadvantageous that each through-hole can only accommodate a limited number of cable lugs, for which there are also not uniform transition resistances owing to different starting torques. When using angled elements made of aluminium, the oxide layer present in the connection region of the cable lugs disadvantageously has to be removed, for example by an additional mechanical operation. In addition, cable lugs have to be separately connected for direct and alternating current. The number of connections and the type of current thus has to be noted at each connection hole.

Furthermore, it is known from DE 195 36 641 C1 to provide an earth connection for electrically and mechanically fastening a plurality of earth wires to a structure, said connection comprising an angled element which is made of metal and comprises two fastening portions, of which one is fastened to the structure and the other is used for electrically connecting the earth wires, the second fastening portion and the earth wires being electrically connected by means of pin and socket contact elements.

The fastening portion which is connected to the earth wires is further formed as a flange which is penetrated by holes, a pin or socket contact element being electrically conductively fastened in each flange hole. The flange is surrounded by a housing consisting of a housing lower part and a housing upper part, the housing lower part comprising a plurality of through-holes and the housing upper part comprising a plurality of fastening bolts, in order to provide mechanical interconnection of the housing parts and simultaneous fastening of the housing to the flange of the angled elements.

Owing to the plurality of different components of the earth connection, there is, however, an increased transition resistance. In addition, the housing formed as a flange comprising a plurality of through-holes has a high weight.

SUMMARY OF THE INVENTION

In this context, one idea of the present invention is to provide an improved earth connection for electrically and mechanically connecting a plurality of earth wires to a structure, which earth connection has a low weight and a low transition resistance.

The invention provides an earth connection for electrically and mechanically connecting a plurality of earth wires to a structure, in particular to an aircraft structure, comprising an angled element which is formed in one piece and is made of electrically conductive material. The angled element comprises a first and a second fastening portion, it being possible to fasten the first fastening portion to the structure and the second fastening portion comprising a plurality of electrical connections for connecting the earth wires. The electrical connections comprise socket contact elements which are formed so as to receive pin contact elements of the earth wires.

Owing to the single-piece formation of the angled element, that is to say from the first fastening portion which can be fastened to the structure to the second fastening portion which comprises a plurality of electrical connections in the form of socket contact elements, a transition resistance can be considerably reduced.

It is preferably provided that the angled element is formed from a metal sheet, in particular an aluminium sheet. Owing to the fact that the angled element is formed in one piece and comprises both the first fastening portion for fastening the angled element to the structure and the second fastening portion for connecting the earth wires, there is a considerable weight saving, in contrast to providing a flange which is penetrated by through-holes.

The earth connection also advantageously comprises a housing, which surrounds at least the second fastening portion. The second fastening portion, which comprises the plurality of electrical connections for connecting the earth wires, is thus protected from external influences.

According to an advantageous development of the invention, it is provided that the housing comprises a cover which is formed from an elastomeric material and contains a plurality of openings. By forming the cover from an elastomeric material, good sealing of the housing is ensured.

It is advantageously provided that the openings are arranged in such a way that the pin contact elements of the earth wires can be inserted into the socket contact elements of the electrical connections through the openings. The pin contact elements of the earth wires can thus be inserted into the socket contact elements of the electrical connections of the angled element in a simple manner.

It is preferably provided that, in the case of earth wires inserted into the openings, the cover has an airtight and watertight connection between the housing and the earth wires. The inside of the housing, in particular the electrical connections, is thus protected from external influences.

According to an advantageous development of the invention, it is provided that the housing comprises a strain relief for relieving the strain of the earth wires which are connected to the angled element. In this way, the provision of external holders for fastening cable bundles can be omitted. External holders of this type likewise have to be attached to the structure in a suitable manner. The omission of external holders thus leads to a reduction in the complexity of the cable guide and to a reduction of the fastening points on the structure.

It is advantageously provided that openings which are not occupied can be filled with filler plugs, which have an airtight and watertight connection to the housing. The housing is thus also airtight and watertight even when only some of the electrical connections are provided with earth wires.

According to an advantageous development of the invention, it is provided that the housing is made of a plastics material or a carbon fibre-reinforced plastics material. This leads to a further weight saving in the earth connection.

The invention further provides an aircraft comprising the earth connection according to the invention.

BRIEF DESCRIPTION OF THE DRAWINGS

Embodiments of the invention are shown in the drawings and are explained in greater detail in the following description.

In the figures.

In the figures, like reference numerals denote like or functionally like components.

DETAILED DESCRIPTION OF THE PREFERRED EMBODIMENTS

Figure 1:
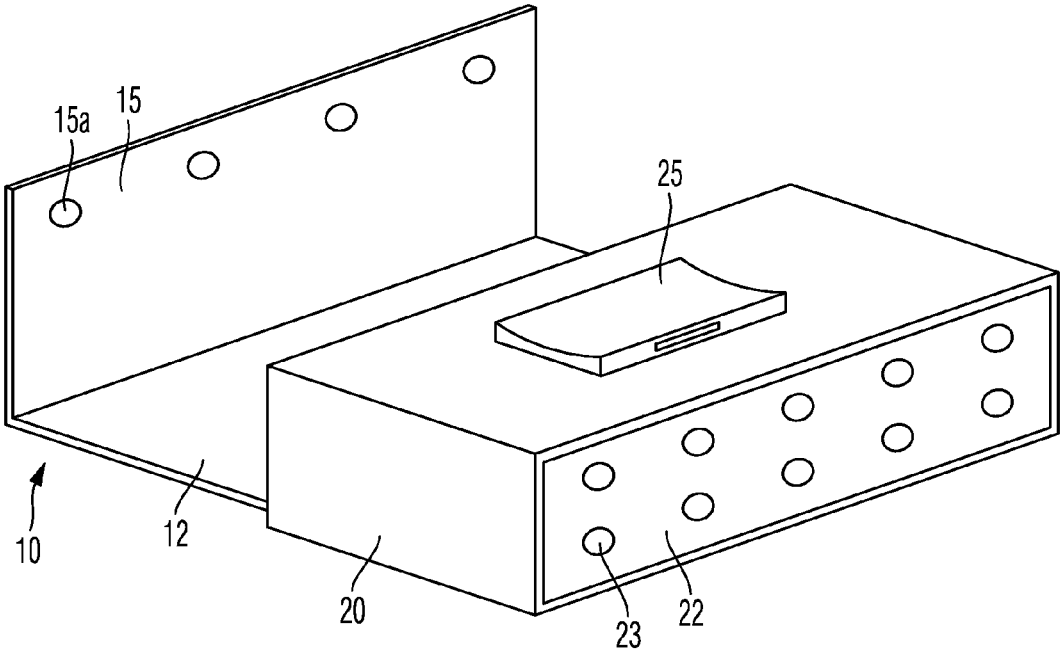
FIG. 1 is a schematic view of an earth connection according to the invention according to a preferred embodiment.

FIG. 1 is a schematic view of an earth connection 10 for electrically and mechanically connecting a plurality of earth wires (not shown) to a structure (not shown). The earth connection 10 comprises an angled element 12 and a housing 20. The angled element 12 is formed from an aluminium sheet and comprises a first and a second (not shown) fastening portion. The angled element 12 has a 90° bend in a region adjacent to the first fastening portion 15. The dimensions and the bend of the angled element 12 are dependent on the attachment position and load of the angled element 12. However, the bend can also have another suitable angle. Instead of an L angle, the bend can be formed in the shape of a Z angle.

The first fastening portion 15 is formed to be fastened to a structure, in particular to an aircraft structure. For this purpose, the first fastening portion 15 comprises a plurality of holes 15a. The connection between the first fastening element 15 and the structure is a riveted connection. However, another suitable connection can also be provided. The second fastening portion (not shown) comprises a plurality of electrical connections for connecting the earth wires.

The housing 20 is in the shape of a cube and is arranged in such a way that the housing 20 surrounds a partial portion of the angled element 12, in particular the second fastening portion (not shown). At a distal end thereof, the housing 20 comprises a cover 22 or a cover plate made of elastomeric material, which comprises a plurality of openings 23. The openings 23 are arranged in such a way that the electrical connections of the second fastening portion (not shown) are arranged therebehind. Earth wires (not shown), which comprise pin contact elements, can be inserted into the housing 20 through the openings 23 in the cover 22, in such a way that the pin contact elements of the earth wires form a contact with the socket contact elements of the electrical connections. The connection between the earth wires (not shown) and the openings 23 in the cover 22 is airtight and watertight.

A strain relief 25 for relieving the strain of the earth wires (not shown) which are connected to the angled element 12 is also arranged on an upper face of the housing 20. The strain relief 25 is made of a plastics material or a carbon fibre-reinforced plastics material. The strain relief 25 is, for example, bonded to the housing 20. Alternatively, the strain relief 25 can also have another suitable connection to the housing 20. The strain relief 25 is formed by a shaped part, which has a planar lower face and an arcuate, curved upper face for receiving a cable bundle of the earth wires. The strain relief 25 comprises an opening in a central region of a side wall, through which opening a cable tie can be guided. The cable bundle of the earth wires is thus fixed to the shaped part of the strain relief by a cable tie. The housing 20 is likewise made of a plastics material or a carbon fibre-reinforced plastics material.

Figure 2:
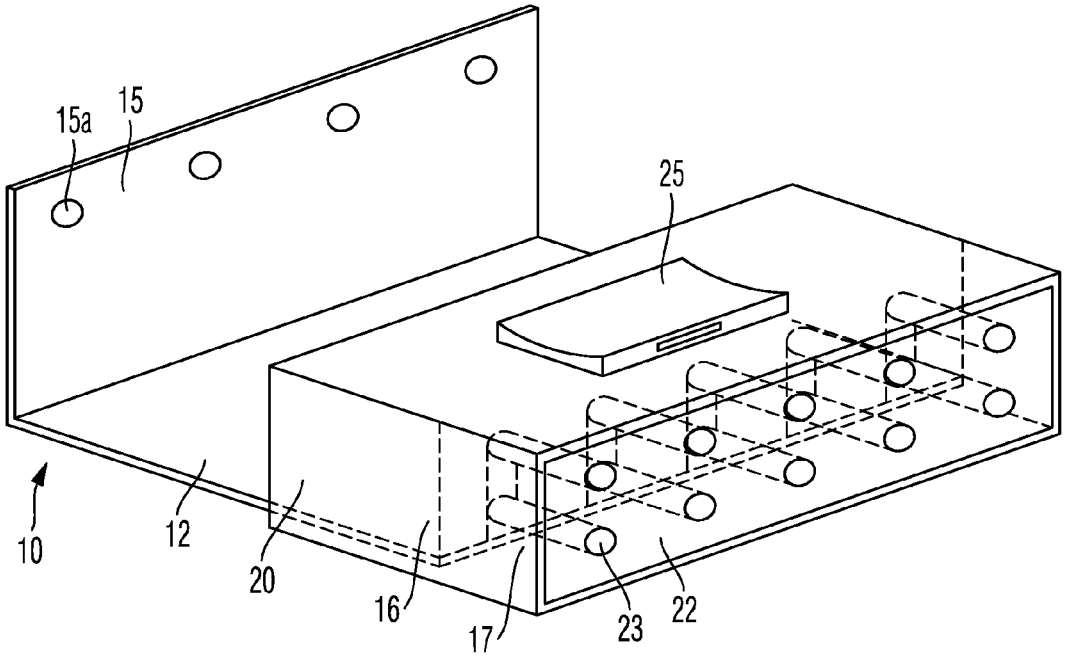
FIG. 2 is a schematic view of the earth connection according to the invention, in particular of the second fastening portion of the angled element according to the preferred embodiment.

FIG. 2 is a schematic view of the earth connection 10 according to the invention for electrically and mechanically connecting the plurality of earth wires to the structure, in particular of the second fastening portion 16, which comprises the plurality of electrical connections 17 for connecting the earth wires.

The angled element 12 is formed in one piece, that is to say it comprises the first fastening portion 15, the horizontal portion of the angled element 12 and the second fastening portion 16. The second fastening portion 16, which is shown by a dashed line, is arranged inside the housing 20. Vertically extending portions of the aluminium sheet are each arranged at a distal end of the horizontal portion of the angled element 12. A pair of electrical connections 17 extends from each of said vertical portions, the electrical connections being formed in the shape of socket contact elements. The socket contact elements are cylindrical and comprise an opening 23 at a distal end of the respective socket contact element.

However, the second fastening portion 16 can also be formed differently. In particular, the second fastening portion 16 can have another suitable connection of the socket contact elements to the horizontal partial portion of the angled element 12.

According to the present embodiment, the second fastening portion 16 comprises ten electrical connections in total in the form of socket contact elements, an upper row and a lower row of five socket contact elements each being provided. The earth wires (not shown) are formed in such a way that each earth wire comprises a pin contact element at one end, which element is formed such that it can be inserted into a respective socket contact element. The pin contact elements of the earth wires are formed in such a way that, when said elements are inserted into the housing 20 through the openings 23 in the cover 22, there is an airtight and watertight connection between the housing 20 and the earth wires. Openings 23 in the housing 20 which are not occupied can be filled with filler plugs (not shown), in such a way that an airtight and watertight connection to the housing is also provided. The plug-in connection between the earth wires and the housing 20 thereby complies with the corresponding MIL standard.

The invention claimed is:

1. An earth connection for electrically and mechanically connecting a plurality of earth wires to a structure, comprising an angled element which is formed in one piece and is made of electrically conductive material, which element comprises a first and a second fastening portion, it being possible to fasten the first fastening portion to the structure and the second fastening portion comprising a plurality of electrical connections for connecting the earth wires, which connections comprise socket contact elements which are formed so as to receive pin contact elements of the earth wires, wherein a housing is provided which surrounds at least the second fastening portion, and wherein the housing comprises a strain relief for relieving a strain of the earth wires which are connected to the angled element.

2. The earth connection according to claim 1, wherein the angled element is formed from a metal sheet.

3. The earth connection according to claim 1, wherein the metal sheet is an aluminium sheet.

4. The earth connection according to claim 1, wherein the housing comprises a cover which is formed from an elastomeric material and contains a plurality of openings.

5. The earth connection according to claim 1, wherein the housing is made of one of a plastics material and a carbon fibre-reinforced plastics material.

6. The earth connection according to claim 1, including an aircraft comprising the structure.

7. An aircraft comprising an earth connection according to claim 1.

8. The earth connection according to claim 4, wherein the openings are arranged in such a way that the pin contact elements of the earth wires can be inserted into the socket contact elements of the electrical connections through the openings.

9. The earth connection according to claim 4, wherein in the case of earth wires inserted into the openings, the cover has an airtight and watertight connection between the housing and the earth wires.

10. The earth connection according to claim 4, wherein openings which are not occupied can be filled with filler plugs, which have an airtight and watertight connection to the housing.

11. An earth connection for electrically and mechanically connecting a plurality of earth wires to a structure, comprising:

an angled element formed in one piece and made of electrically conductive material and comprising a first and a second fastening portion, the first fastening portion having accommodations for fastening the first fastening portion to the structure and the second fastening portion comprising a plurality of electrical connections for connecting the earth wires, the plurality of electrical connections comprising socket contact elements configured so as to receive pin contact elements of the earth wires, wherein a housing is provided which surrounds at least the second fastening portion, and wherein the housing comprises a strain relief for relieving the strain of the earth wires which are connected to the angled element.

* * * * *